US006561774B2

(12) United States Patent
Layman

(10) Patent No.: US 6,561,774 B2
(45) Date of Patent: May 13, 2003

(54) DUAL DIAPHRAGM PUMP

(75) Inventor: Fredrick Layman, Fremont, CA (US)

(73) Assignee: Tokyo Electron Limited (JP)

( * ) Notice: Subject to any disclaimer, the term of this patent is extended or adjusted under 35 U.S.C. 154(b) by 0 days.

(21) Appl. No.: 09/872,634

(22) Filed: May 31, 2001

(65) Prior Publication Data

US 2001/0048882 A1 Dec. 6, 2001

Related U.S. Application Data

(60) Provisional application No. 60/208,823, filed on Jun. 2, 2000.

(51) Int. Cl.[7] ..... F04B 43/06; F04B 45/00

(52) U.S. Cl. ..... 417/395; 417/389; 417/534; 92/99; 92/138

(58) Field of Search ..... 417/395, 383, 417/389, 534, 536, 412, 413.1; 92/99, 100, 101, 96, 138

(56) References Cited

U.S. PATENT DOCUMENTS

| | | | | | |
|---|---|---|---|---|---|
| 2,625,886 | A | * | 1/1953 | Browne | 103/150 |
| 4,247,264 | A | * | 1/1981 | Wilden | 417/393 |
| 4,367,140 | A | | 1/1983 | Wilson | 210/110 |
| 4,406,596 | A | | 9/1983 | Buddle | 417/393 |
| 4,478,560 | A | * | 10/1984 | Rupp | 417/393 |
| 4,549,467 | A | * | 10/1985 | Wilden et al. | 91/307 |
| 4,682,937 | A | * | 7/1987 | Credle, Jr. | 417/393 |
| 4,778,356 | A | * | 10/1988 | Hicks | 417/397 |
| 4,854,832 | A | * | 8/1989 | Gardner et al. | 417/393 |
| 5,062,770 | A | * | 11/1991 | Story et al. | 417/46 |
| 5,169,296 | A | | 12/1992 | Wilden | 417/395 |
| 5,188,515 | A | * | 2/1993 | Horn | 417/63 |
| 5,195,878 | A | | 3/1993 | Sahiavo et al. | 417/393 |
| 5,213,485 | A | * | 5/1993 | Wilden | 417/393 |
| 5,222,876 | A | | 6/1993 | Buddle | 417/393 |
| 5,232,352 | A | * | 8/1993 | Robinson | 417/393 |
| 5,240,390 | A | * | 8/1993 | Kvinge et al. | 417/393 |
| 5,649,809 | A | * | 7/1997 | Stapelfeldt | 417/63 |
| 6,024,801 | A | | 2/2000 | Wallace et al. | 134/1 |
| 6,149,828 | A | | 11/2000 | Vaartstra | 216/57 |
| 6,228,563 | B1 | | 5/2001 | Starov et al. | 430/327 |
| 6,242,165 | B1 | | 6/2001 | Vaartstra | 430/329 |

FOREIGN PATENT DOCUMENTS

| | | | |
|---|---|---|---|
| CH | 251213 | 2/1946 | |
| GB | 2 003 975 A | 3/1979 | F04B/43/06 |

OTHER PUBLICATIONS

Joseph L. Foszcz, "Diaphragm Pumps Eliminate Seal Problems", Plant Engineering, http://www.manufacturing.net/magazine, Jun. 1, 1998.

Wilden Air–Operated Diaphragm Pumps "Diaphragm Pump Dynamics . . . ", http://www.frontpageaccess.com/pitt/wil2.htm, Jun. 1, 1998.

* cited by examiner

*Primary Examiner*—Charles G. Freay
*Assistant Examiner*—Han L Liu
(74) *Attorney, Agent, or Firm*—Haverstock & Owens LLP

(57) ABSTRACT

A dual diaphragm pump comprises a first chamber, a second chamber, a mechanical link, and a drive mechanism. The first chamber comprises a first cavity and a first diaphragm. The first chamber couples a pump inlet to a pump outlet. The second chamber comprises a second cavity and a second diaphragm. The second chamber couples the pump inlet to the pump outlet. The mechanical link couples the first diaphragm of the first chamber to the second diaphragm of the second chamber. The drive mechanism couples to the first diaphragm and the second diaphragm. In operation, the drive mechanism drives the first diaphragm causing first fluid within the first cavity to exit the pump outlet while causing second fluid to be drawn from the pump inlet into the second cavity. Further in operation, the mechanical link imparts an inlet pressure force from the second diaphragm to the first diaphragm.

22 Claims, 2 Drawing Sheets

DUAL DIAPHRAGM PUMP

RELATED APPLICATIONS

This application claims priority from U.S. Provisional Patent Application No. 60/208,823, filed on Jun. 2, 2000, which is incorporated by reference.

FIELD OF THE INVENTION

This invention relates to the field of pumping. More particularly, this invention relates to the field of pumping where a fluid being pumped is at an elevated pressure.

BACKGROUND OF THE INVENTION

A diaphragm pump of the prior art includes a diaphragm chamber, an inlet check valve, an outlet check valve, and a drive mechanism. The diaphragm chamber includes a pump cavity and a diaphragm. The diaphragm chamber couples to a pump inlet via the inlet check valve. The diaphragm chamber couples to a pump outlet via the outlet check valve. The drive mechanism couples to the diaphragm. In operation, the diaphragm and the pump cavity initially retain a volume of fluid. Next, the drive mechanism causes the diaphragm to be pushed into the pump cavity. This causes the inlet check valve to close and the outlet check valve to open, which results in the volume of fluid exiting the pump outlet.

Normally, the diaphragm pump is used to boost pressure from a low pressure to a high pressure. However, it would be advantageous to have a diaphragm pump that boosts pressure from the high pressure to the high pressure plus a head pressure. Also, it would be advantageous to have a diaphragm pump that boosts pressure from the high pressure in an efficient manner.

What is needed is a diaphragm pump which boosts pressure from a high pressure to the high pressure plus a head pressure.

What is needed is a diaphragm pump which boosts pressure from a high pressure in an efficient manner.

SUMMARY OF THE INVENTION

A dual diaphragm pump of the present invention comprises a first chamber, a second chamber, a mechanical link, and a drive mechanism. The first chamber comprises a first cavity and a first diaphragm. The first chamber couples a pump inlet to a pump outlet. The second chamber comprises a second cavity and a second diaphragm. The second chamber couples the pump inlet to the pump outlet. The mechanical link couples the first diaphragm of the first chamber to the second diaphragm of the second chamber. The drive mechanism couples to the first diaphragm and the second diaphragm. In operation, the drive mechanism drives the first diaphragm causing first fluid within the first cavity to exit the pump outlet while causing second fluid to be drawn from the pump inlet into the second cavity. Further in operation, the mechanical link imparts an inlet pressure force from the second diaphragm to the first diaphragm.

DETAILED DESCRIPTION OF THE PREFERRED EMBODIMENT

Figure 1:
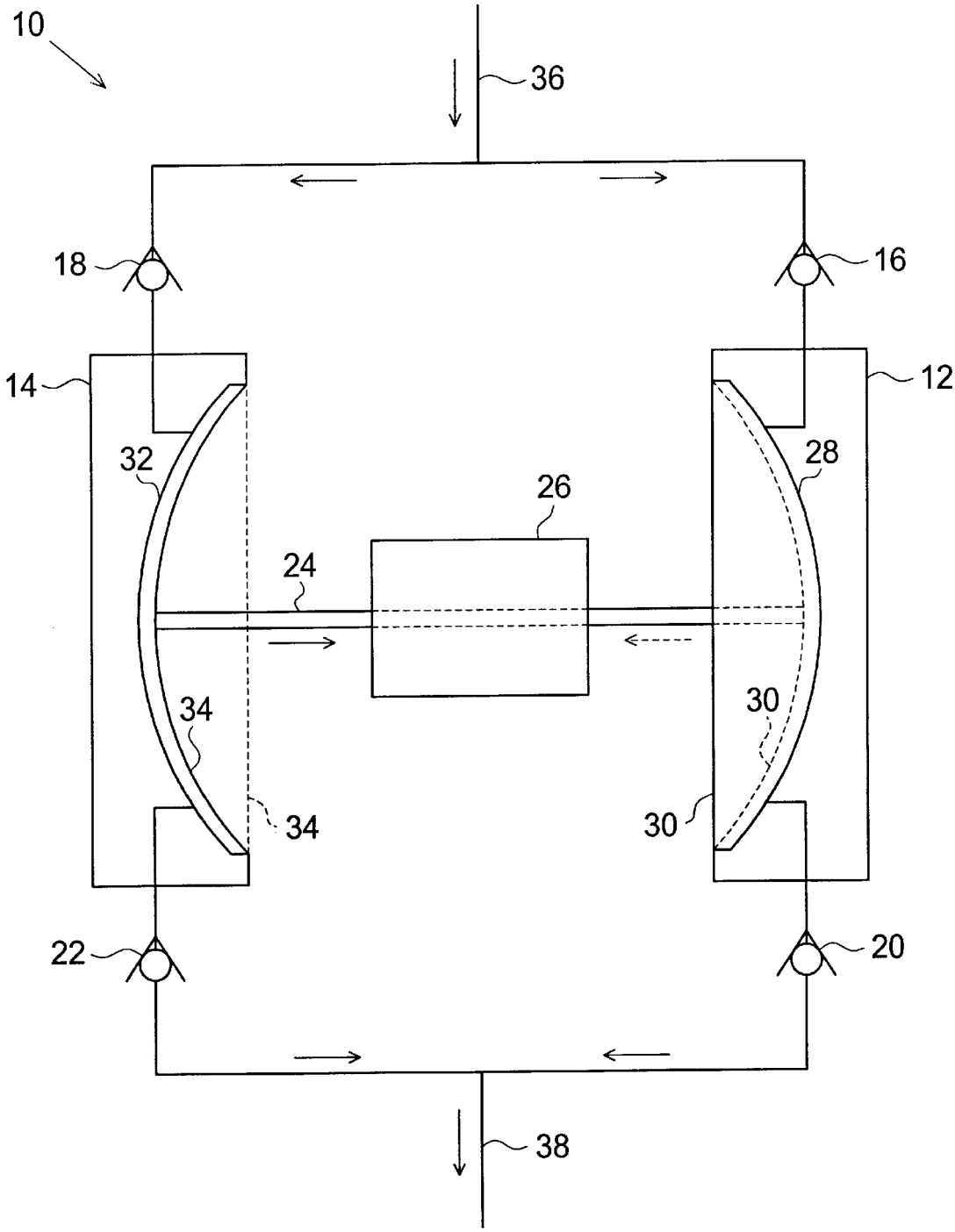
FIG. 1 illustrates the preferred diaphragm pump of the present invention.

The preferred diaphragm pump of the present invention is illustrated in FIG. 1. The preferred diaphragm pump 10 comprises first and second diaphragm chambers, 12 and 14, first and second inlet check valves, 16 and 18, first and second outlet check valves, 20 and 22, a mechanical link 24, and a drive mechanism 26. The first diaphragm chamber 12 comprises a first pump cavity 28 and a first diaphragm 30. The second diaphragm chamber comprises a second pump cavity 32 and a second diaphragm 34.

The first diaphragm chamber 12 is coupled to a pump inlet 36 via the first inlet check valve 16. The first diaphragm chamber 12 is coupled to a pump outlet 38 via the first outlet check valve 20. The second diaphragm chamber 14 is coupled to the pump inlet 36 via the second inlet check valve 18. The second diaphragm chamber 14 is coupled to the pump outlet 38 via the second outlet check valve 22. The mechanical link 24 couples the first diaphragm 30 to the second diaphragm 34.

Preferably, the drive mechanism 26 is coupled to the mechanical link 24, which in turn couples the drive mechanism 26 to the first and second diaphragms, 30 and 34. Alternatively, the drive mechanism 26 is coupled to the first and second diaphragms, 30 and 34, independent of the mechanical link 24. Preferably, the mechanical link 24 is a solid member. Alternatively, the mechanical link 24 is a liquid link such as an hydraulic link. Further alternatively but with less effectiveness, the mechanical link 24 is a gas link such as a pneumatic link.

Operation of the preferred pump 10 occurs over a pump cycle, which has first and second phases. In the first phase, the first pump cavity 28 and the first diaphragm 30 initially retain a first volume of fluid. Concurrently, the second pump cavity 32 and the second diaphragm 34 retain only a second small residual volume of fluid. Next, the drive mechanism 26 drives the first diaphragm 30 into the first pump cavity 28 while concurrently withdrawing the second diaphragm 34 from the second pump cavity 32. This causes the first inlet check valve 16 to close and the first outlet check valve 20 to open causing most of the first volume of fluid to be driven out the pump outlet 38 leaving a first small residual volume of fluid in a first space defined by the first diaphragm 30 and the first pump cavity 28. This also causes the second inlet check valve 18 to open and the second outlet check valve 22 to close causing a second volume of fluid to be drawn into a second space defined by the second pump cavity 32 and the second diaphragm 34.

In the second phase, the second pump cavity 32 and the second diaphragm 34 initially retain the second volume of fluid. Concurrently, the first pump cavity 28 and the first diaphragm 30 retain the first small residual volume of fluid. Next, the drive mechanism drives the second diaphragm 34 into the second pump cavity 32 while concurrently withdrawing the first diaphragm 30 from the first pump cavity 28. This causes the second inlet check valve 18 to close and the second outlet check valve 22 to open causing most of the second volume of fluid to be driven out the pump outlet 38 leaving the second small residual volume of fluid in the second space defined by the second pump cavity 32 and the second diaphragm 34. This also causes the first inlet check valve 16 to open and the first outlet check valve 20 to close causing the first volume of fluid to be drawn into the first space defined by the first pump cavity 28 and the first diaphragm 30.

Preferably, the fluid at the pump inlet 36 is at an elevated gauge pressure, i.e., a pressure above atmospheric pressure. Preferably, the preferred pump imparts a head pressure to the fluid at the pump outlet 38. In such a situation, the drive mechanism 26 imparts a head pressure force to the first diaphragm 30 during the first phase while the second diaphragm 34, via the mechanical link 24, imparts an elevated gauge pressure force against the first diaphragm 30 during the first phase.

A first phase work performed on the first volume of fluid includes a head pressure work and an elevated gauge pressure work. The head pressure work is the product of the head pressure and the first volume of fluid. The elevated gauge pressure work is the product of the elevated gauge pressure and the first volume of fluid. Since the elevated gauge pressure work in the first phase is imparted by the second diaphragm 34, the drive mechanism 26 only performs the head pressure work. Thus, the preferred pump 10 operates with an efficiency advantage over a single diaphragm pump because the single diaphragm pump would have to perform the elevated gauge pressure work as well as the pump head work.

An example illustrates the efficiency advantage of the preferred pump 10. If the elevated gauge pressure is 900 psi, the head pressure is 100 psi, and the first volume of fluid is 10 cu. ins., the total work performed on the first volume of fluid is 9,000 in. lbs. while the head pressure work is 1,000 in. lbs. In this situation, the preferred pump 10 is 90% more efficient than the single diaphragm pump.

Figure 2:
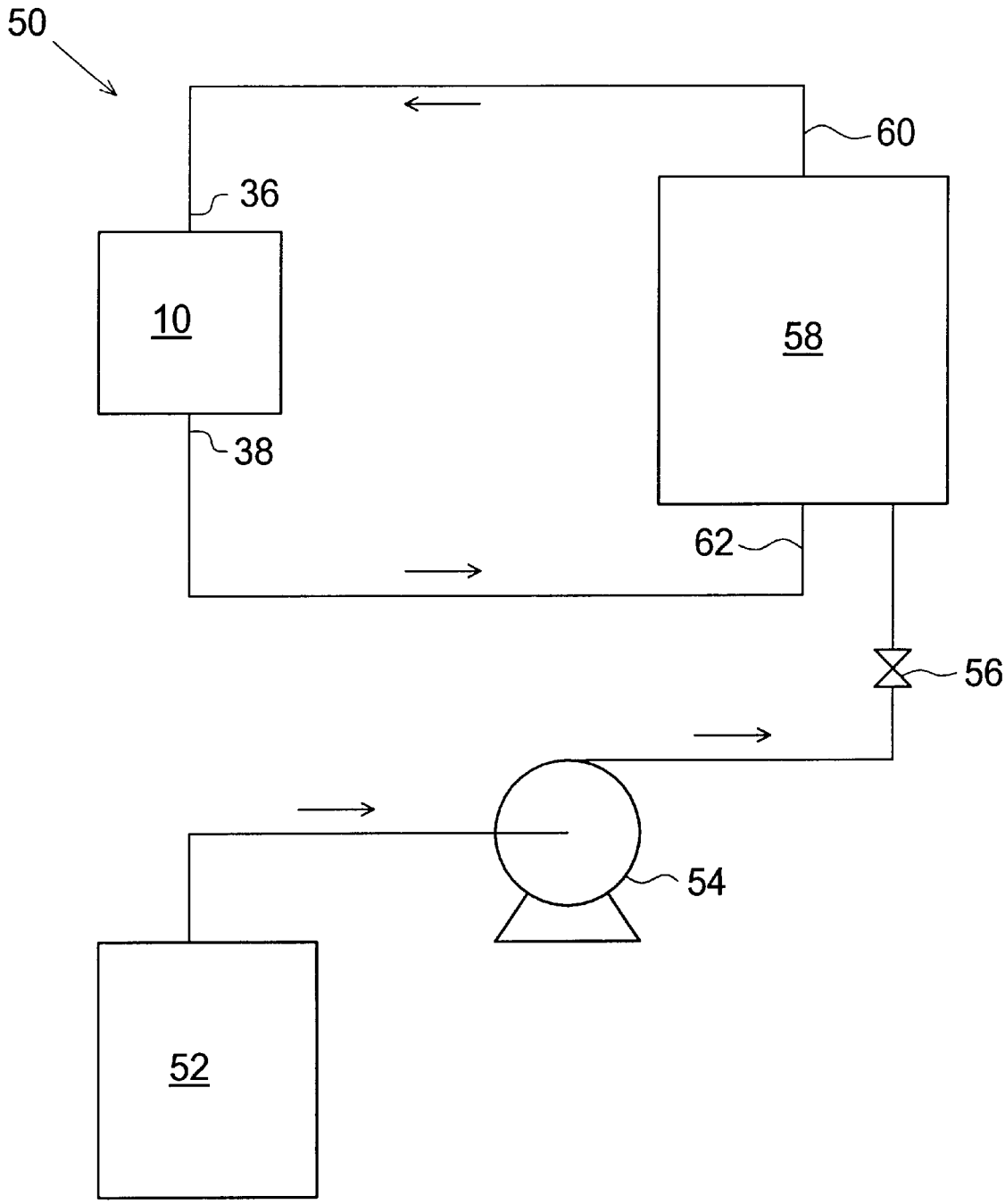
FIG. 2 schematically illustrates an application of the preferred diaphragm pump of the present invention.

A supercritical processing system employing the preferred pump 10 is schematically illustrated in FIG. 2. Preferably, the supercritical processing 50 is used for processing semiconductor substrates. Alternatively, the supercritical processing system 50 is used for processing other workpieces. The supercritical processing system 50 comprises a fluid reservoir 52, a high pressure pump 54, a fill/shutoff valve 56, a supercritical processing chamber 58, first and second circulation lines, 60 and 62, and the preferred pump 10.

The fluid reservoir 52 is coupled to the high pressure pump 54. The high pressure pump is coupled to the supercritical processing chamber 58 via the fill/shutoff valve 56. The preferred pump 10 is coupled to the supercritical processing chamber 58 via the first and second circulation lines, 60 and 62. The supercritical processing chamber 58, the first circulation line 60, the preferred pump 10, and the second circulation line 62 form a circulation loop.

Operation of the supercritical processing system is divided into a fill phase, a processing phase, and an exhaust phase. In the fill phase, the high pressure pump 54 pumps fluid, preferably carbon dioxide, from the fluid reservoir 52 to the supercritical processing chamber 58 until desired supercritical conditions are reached in the supercritical chamber 58 and throughout the circulation loop. Then the fill/shutoff valve 56 is closed and the high pressure pump 54 is stopped.

In the processing phase, the supercritical fluid is circulated through the circulation loop by the preferred pump 10. Circulation of the supercritical fluid allows filtering of the supercritical fluid, allows the supercritical fluid to pass through a chemical dispensing mechanism, allows heating of the supercritical fluid, and allows energy to be imparted to the supercritical fluid so that the supercritical fluid can do work such as turbulent mixing or momentum transfer. For supercritical carbon dioxide, the elevated gauge pressure at the pump inlet 36 is at least about 1,100 psi. Preferably, for the supercritical processing, the head pressures is about 50–150 psi. At the end of the processing phase, the preferred pump 10 is stopped.

In the exhaust phase, the supercritical processing chamber 58 is exhausted through an exhaust line (not shown) to an exhaust gas collection vessel (not shown).

Preferably, the supercritical fluid used in the supercritical processing system 50 is the supercritical carbon dioxide. Alternatively, the supercritical fluid is another supercritical fluid such as supercritical ammonia or supercritical water.

The preferred pump 10 is advantageously configured for the supercritical processing of the semiconductor substrates. As described above, the preferred pump 10 operates with the efficiency advantage when the elevated gauge pressure exceeds the head pressure. Here, the elevated head pressure for the supercritical carbon dioxide is at least about 1,100 psi while the head pressure has a maximum of about 150 psi. So the preferred pump 10 will operate with the efficiency advantage in the circulation loop. Further, processing of the semiconductor substrates requires system components to be clean, to be reliable, and to not generate particulates. Diaphragm pumps have few moving parts which generate particulates so the preferred pump 10 meets the non-generation of particulates criteria. Also, by minimizing dead volume, employing a self cleaning design, and designing for reliable operation, the preferred pump 10 will meet the cleanliness and reliability criteria.

The supercritical processing system 50 is a particular application for the preferred pump 10. Alternatively, the preferred pump 10 is used in any application where fluid is pumped from the elevated gauge pressure to the elevated gauge pressure plus the head pressure. Further alternatively, the preferred pump 10 will operate in any application where a diaphragm pump operates.

It will be readily apparent to one skilled in the art that other various modifications may be made to the preferred embodiment without departing from the spirit and scope of the invention as defined by the appended claims.

What is claimed is:

1. A pump for pumping a supercritical fluid comprising:

a. a first chamber comprising a first cavity and a first diaphragm, the first chamber coupled to a pump inlet and a pump outlet;

b. a second chamber comprising a second cavity and a second diaphragm, the second chamber coupled to the pump inlet and the pump outlet;

c. a mechanical link coupling the first diaphragm of the first chamber to the second diaphragm of the second chamber; and d. a drive mechanism coupled to the mechanical link, wherein the drive mechanism drives the mechanical link to actuate the first diaphragm and the second diaphragm in opposing directions, wherein the mechanical link directly applies a force to the first diaphragm and the second diaphragm such that the force drives the first diaphragm, thereby causing supercritical fluid within the first cavity to exit the pump outlet while causing supercritical fluid to be drawn from the pump inlet into the second cavity and further such that in operation the mechanical link imparts an inlet pressure force from the second diaphragm to the first diaphragm.

2. The pump of claim 1 wherein the first chamber comprises a first inlet check valve coupling the pump inlet to the first chamber and further wherein the first chamber comprises a first outlet check valve coupling the first chamber to the pump outlet.

3. The pump of claim 1 wherein the second chamber comprises a second inlet check valve coupling the pump inlet to the second chamber and further wherein the second chamber comprises a second outlet check valve coupling the second chamber to the pump outlet.

4. The pump of claim 1 wherein the mechanical link comprises a solid link.

5. The pump of claim 1 wherein the mechanical link comprises a liquid link.

6. The pump of claim 5 wherein the liquid link comprises an hydraulic link.

7. The pump of claim 1 wherein the mechanical link comprises a gas link.

8. The pump of claim 7 wherein the gas link comprises an pneumatic link.

9. A pump for pumping a supercritical fluid comprising:

a. a first chamber comprising a first cavity and a first diaphragm;

b. a first inlet check valve coupling the first chamber to a pump inlet;

c. a first outlet check valve coupling the first chamber to a pump outlet;

d. a second chamber comprising a second cavity and a second diaphragm;

e. a second inlet check valve coupling the second chamber to the pump inlet;

f. a second outlet check valve coupling the second chamber to the pump outlet;

g. a mechanical link coupling the first diaphragm of the first chamber to the second diaphragm of the second chamber; and h. a drive mechanism coupled to the mechanical link, wherein the drive mechanism drives the mechanical link to apply a selective force to the first diaphragm and the second diaphragm.

10. A method of pumping a supercritical fluid at an elevated gauge pressure comprising the steps of:

a. balancing a first diaphragm of a first diaphragm pump chamber against a second diaphragm of a second diaphragm pump chamber using a mechanical link;

b. driving the mechanical link to apply a force to the first diaphragm to impart a differential work to the supercritical fluid within the first diaphragm pump chamber where the differential work corresponds proximately to a first product of a pump head pressure and a displaced volume of the first diaphragm pump chamber; and c. assisting the first diaphragm pump chamber using the mechanical link between the first and second diaphragms to impart a baseline work corresponding proximately to a second product of the elevated gauge pressure and the displaced volume of the first diaphragm chamber.

11. A supercritical fluid circulation loop comprising:

a. a supercritical processing chamber having a first circulation line and a second circulation line; and b. a pump for circulating a supercritical fluid with the supercritical processing chamber, the pump further comprising:

i. a first chamber having a first cavity and a first diaphragm, the first chamber coupled to the first circulation line and the second circulation line;

ii. a second chamber comprising a second cavity and a second diaphragm, the second chamber coupled to the first circulation line and the second circulation line; and iii. an actuator assembly coupled to the first diaphragm and the second diaphragm, such that the actuator assembly causes the supercritical fluid within the first cavity to exit the second circulation line while causing the supercritical fluid to be drawn from the first circulation line into the second cavity by imparting an inlet pressure force from the second diaphragm to the first diaphragm.

12. The supercritical fluid circulation loop according to claim 11 further comprising:

a. a reservoir having a fluid;

b. a high pressure pump coupled to the reservoir, wherein the high pressure pump pumps the fluid to the supercritical processing chamber; and c. a valve coupled to the high pressure pump, wherein the valve is closed when the fluid has reached a supercritical state.

13. The supercritical fluid circulation loop according to claim 11, wherein the pump further comprises a first inlet check valve coupling the first circulation line to the first chamber and further wherein the first chamber comprises a first outlet check valve coupling the first chamber to the second circulation line.

14. The supercritical fluid circulation loop according to claim 11, wherein the pump further comprises a second inlet check valve coupling the first circulation line to the second chamber and further wherein the second chamber comprises a second outlet check valve coupling the second chamber to the second circulation line.

15. The supercritical fluid circulation loop according to claim 11 wherein the actuator assembly further comprises:

a. a mechanical link coupled to the first diaphragm and the second diaphragm; and b. a drive mechanism coupled to mechanical link, wherein the drive mechanism drives the mechanical link between a first position and a second position.

16. The supercritical fluid circulation loop according to claim 15, wherein the mechanical link further comprises a solid link.

17. The supercritical fluid circulation loop according to claim 15, wherein the mechanical link comprises a liquid link.

18. The supercritical fluid circulation loop according to claim 17, wherein the liquid link comprises an hydraulic link.

19. The supercritical fluid circulation loop according to claim 15, wherein the mechanical link comprises a gas link.

20. The supercritical fluid circulation loop according to claim 19, wherein the gas link comprises an pneumatic link.

21. A pump for pumping a supercritical fluid, the pump coupled to a pump inlet and a pump outlet, wherein the supercritical fluid is at an elevated gauge pressure at the pump inlet, the pump comprising:

a. a first chamber having a first cavity and a first diaphragm, the first chamber coupled to the pump inlet and the pump outlet, wherein the first diaphragm moves between a first position and a second position, the first diaphragm in the first position when the supercritical fluid is within the first chamber;

b. a second chamber having a second cavity and a second diaphragm, the second chamber coupled to the pump inlet and the pump outlet, wherein the second diaphragm moves between a third position and a fourth position, the second diaphragm in the fourth position when the supercritical fluid is in the second chamber; and d. a mechanical link for driving the first diaphragm from the first position to the second position using a driving force, wherein the driving force includes the elevated gauge pressure of the supercritical fluid entering the second chamber when the second diaphragm is moving between the third position and the fourth position.

22. The pump according to claim 21 wherein the driving force further includes a head pressure force supplied directly from the drive assembly.

* * * * *